United States Patent [19]

Buller

[11] Patent Number: 4,694,175

[45] Date of Patent: Sep. 15, 1987

[54] THERMAL DAMPER FOR INFRARED DETECTOR

[75] Inventor: Joseph S. Buller, Santa Barbara, Calif.

[73] Assignee: Santa Barbara Research Center, Goleta, Calif.

[21] Appl. No.: 807,924

[22] Filed: Dec. 12, 1985

[51] Int. Cl.[4] ..... G01J 1/04

[52] U.S. Cl. ..... 250/352; 250/370; 62/514 R

[58] Field of Search ..... 250/352, 353, 370 L; 62/514 R

[56] References Cited

U.S. PATENT DOCUMENTS 3,601,611 8/1971 Kendall, Sr. ..... 250/352
4,161,747 7/1979 Jennings ..... 357/74
4,300,360 11/1981 Chanin et al. ..... 62/514 R
4,606,194 8/1986 Pirtle et al. ..... 62/6

*Primary Examiner*—Carolyn E. Fields
*Assistant Examiner*—Richard Hanig
*Attorney, Agent, or Firm*—Ronald L. Taylor; A. W. Karambelas

[57] ABSTRACT

The present invention is directed to a method and apparatus for reducing temperature variation in an infrared detector. The apparatus comprises a coldfinger for receiving thermal energy from an infrared detector. A thermal damper is also provided for conducting thermal energy from said detector to the coldfinger by one or more thermally conductive paths. A detector mount is used for combining the thermal energy flowing through the paths, thereby reducing the temperature variation in the detector.

20 Claims, 3 Drawing Figures

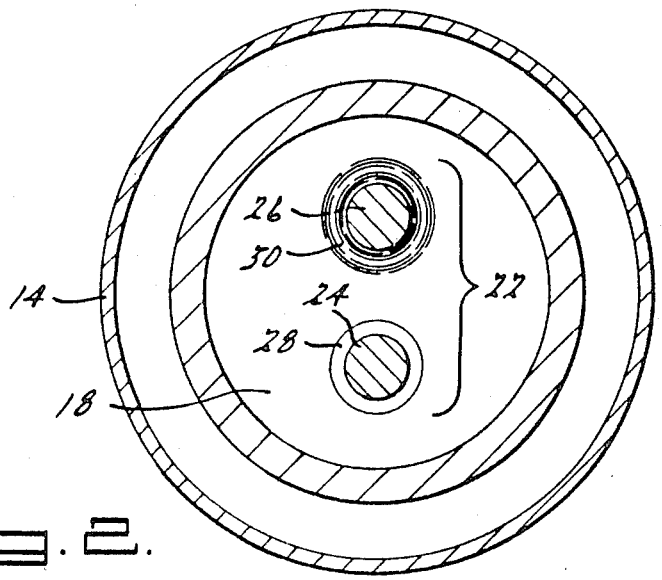
FIG. 2.
FIG. 3.
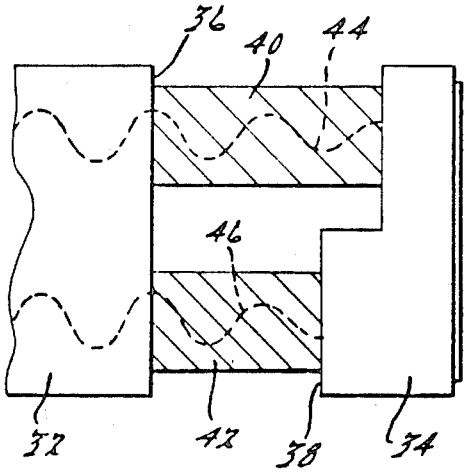

THERMAL DAMPER FOR INFRARED DETECTOR

BACKGROUND OF THE INVENTION

1. Field of the Invention

This invention relates to the field of infrared detection, and more particularly to a thermal damper for minimizing temperature variation in an infrared detector.

2. Description of Related Art

Infrared detectors are often used in conjunction with missiles and night vision systems to sense the presence of electromagnetic radiation having wavelengths of 1–15 μm. Because they are often most sensitive when operating at low temperatures, detectors such as those fabricated from mercury-cadmium-telluride generally require a cryoengine assembly to produce and maintain the necessary low operating temperature. Such cryoengine assemblies are typically used in conjunction with an evacuated dewar in which an infrared detector is placed. The dewar is evacuated to remove gases which would otherwise occupy the region surrounding the detector so that heat loss through convection and conduction is minimized.

The detector is typically cooled by placing an indented region ("coldwell") of the dewar in contact with an expansion chamber ("coldfinger") of the cyroengine assembly. Alternatively, the coldfinger of the cyroengine assembly is used as the coldwell of the dewar to enable the detector to be mounted on the cryoengine coldfinger. The cryoengine assembly produces cooling by sequential compression of the working fluid such as helium, removal of the heat of compression of the fluid, and subsequent expansion of the working fluid in the coldfinger. Because the detector is in thermal communication with the coldfinger, the expansion of the working fluid causes heat to be withdrawn from the detector.

Although the necessary operating temperatures can be achieved by the devices generally described above, the cyclical nature of the expansion of the working fluid would often produce a cyclical variation in the detector operating temperature. Because infrared detectors are often temperature sensitive, this cyclical variation in operating temperature would produce a corresponding variation in the output signal of the detector. Thermal masses or resistances located between the detector and the coldfinger were often employed to minimize this temperature variation. While such solutions were somewhat effective in reducing temperature variation, they would often increase the time required to initially cool the detector from ambient to the necessary operating temperature. In addition, the use of a thermal resistor would often hinder the flow of thermal energy between the coldfinger and the detector, which would in turn generally require the use of a cryoengine assembly having a greater cooling capacity than would otherwise be necessary.

SUMMARY OF THE INVENTION

A method and apparatus for reducing temperature variation in an infrared detector is disclosed. The apparatus includes a coldfinger for receiving thermal energy from a detector and a thermal damper for conducting thermal energy from the detector to the coldfinger by way of one or more thermally conductive paths. The paths are preferably solid studs whose lengths and materials are chosen so as to minimize temperature variation in the detector.

BRIEF DESCRIPTION OF THE DRAWINGS

Various advantages of the present invention will become apparent to one skilled in the art upon reading the following specification and reference to the drawings in which:

FIG. 2 is a cross-sectional view of the infrared detector assembly taken along line 2—2 of FIG. 1; and FIG. 3 is an alternative embodiment of the thermal damper according to the present invention.

DESCRIPTION OF THE PREFERRED EMBODIMENTS

Figure 1:
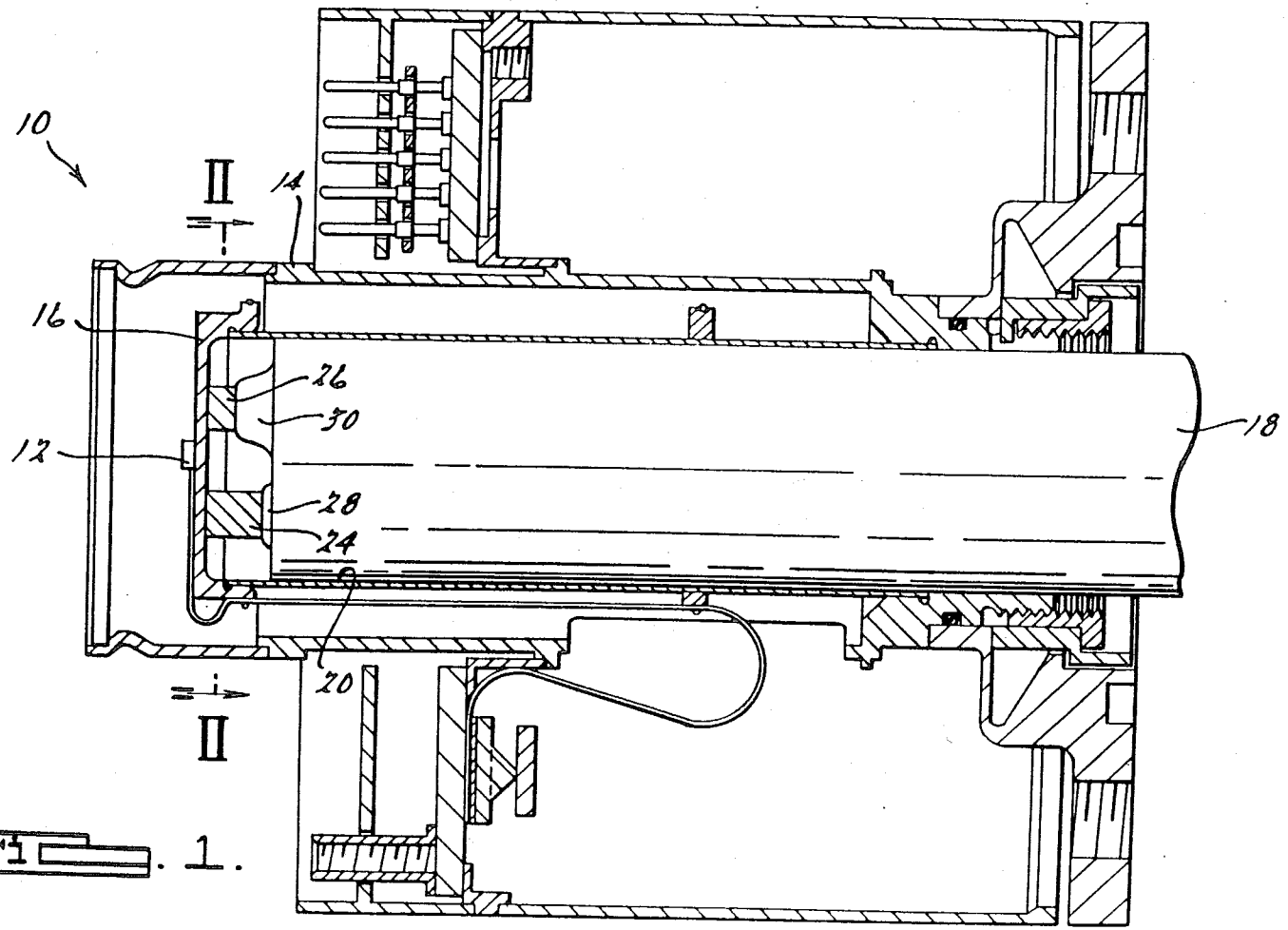
FIG. 1 is a cross-sectional view of an infrared detector assembly using the thermal damper according to the present invention.

Referring to FIG. 1, to detect incoming infrared signals, an infrared detector assembly 10 is provided having an infrared detector 12. The infrared detector 12 is mounted in a dewar 14 which is evacuated to remove gases which may otherwise increase the flow of thermal energy from the environment to the detector 12. To support the infrared detector 12, a detector mount 16 is located within the assembly 10 and is positioned to allow infrared signals entering the dewar 14 to be received by the detector 12. While the detector mount 16 may be fabricated from copper, it is to be understood that other suitable materials may be used.

Receiving thermal energy from the dewar 14 and the infrared detector 12 is a coldfinger 18, which is located within the coldwell 20 of the dewar 14. Thermal energy is drawn from the detector 12 by the expansion of a working fluid inside the coldfinger 18. By cooling the detector 12 in this manner, the detector 12 is able to operate at a temperature where it is most sensitive. While a coldfinger 18 is used to receive thermal energy from the detector 12, it is to be understood that other means for receiving thermal energy from the detector 12 may be used.

To reduce the temperature variations in the infrared detector 12 due to the cyclical operation of the expander, a thermal damper 22 is provided which allows thermal energy to flow between the coldfinger 18 and the detector 12. The thermal damper 22 includes two studs 24 and 26, though it is to be understood that a different number of studs may be used as discussed subsequently. The studs 24 and 26 are disposed between the detector mount 16 and two bosses 28 and 30 on the cold tip of the coldfinger 18. The bosses 28 and 30 are used to complete the paths of thermal energy flowing from the detector 12 through the studs 24 and 26 to the coldfinger 18. While the studs 24 and 26 may be composed of stainless steel or titanium, it is to be understood that other suitable materials may be used.

The temperature of the studs 24 and 26 may be shown to vary approximately according to the following equation:

$$T_o = T_i e^{-l\sqrt{\pi f C_p/k}} \cos(2\pi f\tau - l\sqrt{\pi f C_p/k})$$

Where:

$T_o$=temperature variation at the end of the stud adjacent to the detector mount $T_i$=temperature variation at the end of the stud adjacent to the coldfinger l=length of stud f=expander cyclical frequency (Hz)

Cp=specific heat of stud k=thermal conductivity of stud $\tau$=time

Accordingly, the construction of the studs 24 and 26 may be chosen to optimize the above equation. The lengths and composition of the studs 24 and 26 are selected to achieve the necessary detector operating temperature and optimum temperature variation. By appropriate selection of these parameters, the phase angles of the temperature waves flowing through the studs 24 and 26 may be shifted with respect to each other. By shifting the phase angle of the temperature wave through stud 26 such that it becomes out of phase with respect to the wave flowing through stud 24, the fluctuations in temperature of the studs 24 and 26 effectively offset each other when the thermal energy flowing through the studs 24 and 26 is combined at the detector mount 16. The phase lag required to minimize temperature variation in the detector 12 is somewhat less than 180° due to the damping factor $e^{-l\sqrt{\pi fCp/k}}$ in the equation, which makes the amplitude of the temperature wave in the longer of two studs smaller than the other. A 180° degree phase shift will continue to be used in the discussion in the interest of simplicity.

The operation of the thermal damper 22 may be explained by means of a non-limiting example. Assuming that the temperature of the cold tip of the coldfinger 18 has a fluctuation of ±1° K., the thermal damper 22 can be designed so that the amplitude of the temperature wave flowing through the stud 26 is at its maximum (+1° K.) while the amplitude of the temperature wave flowing through stud 24 is at its minimum (−1° K.) when the waves act upon the detector mount 16. If the materials for both of the studs are the same, then this 180° phase shift can be accomplished by making stud 24 one-half wavelength longer than stud 26. Assuming the studs 24 and 26 are made from grade 304 stainless steel, one-half wavelength corresponds to a stud length of $l=\sqrt{\pi k/fCp}$ or 0.044 inches. Because it is substantially independent of the temperature variation of the detector 12, the cross-sectional areas of the studs 24 and 26 are selected to meet the minimum requirements for structural integrity, conductivity, and other factors which depend on the particular application and which do not directly influence temperature variation. In one particular configuration, for example, the stud 24 is 0.20 inches long, 0.10 inches in diameter and constructed of 304 stainless steel, whereas the stud 26 is 0.244 inches long, 0.10 inches in diameter and is also constructed of 304 stainless steel.

In an alternative preferred embodiment of the present invention as shown in FIG. 3, the cold tip of the coldfinger 32 has a planar surface 36 and the opposing surface of the detector mount 34 has a nonplanar surface 38. The nonplanar surface 38 serves to eliminate the need for the bosses 28 and 30 of FIGS. 1 and 2. The surfaces 36 and 38 are adapted to locate two studs 40 and 42 having the requisite length and fabricated from appropriate materials so as to create an offsetting phase shift in the temperature waves 44 and 46 flowing therethrough. The temperature wave 44 flowing through the stud 40 therefore combines with the temperature wave 46 flowing through the stud 42 in the detector mount 34 thereby minimizing the temperature variation in the detector 12.

In practicing the method of the present invention, a source of thermal energy such as coldfinger 18 is provided. The studs 24 and 26 are located between the coldfinger 18 and the detector mount 16. The studs 24 and 26 divide the flow of thermal propagating between the detector mount 16 and the coldfinger 18 into two paths having two corresponding temperature waves 44 and 46. The phase shift between the temperature waves 44 and 46 is produced by the appropriate selection of the lengths and compositions of the studs 24 and 26 as discussed above. The temperature waves 44 and 46 are then recombined at the detector mount 16 causing the temperature waves 44 and 46 to offset one another. By offsetting the temperature waves 44 and 46 in this manner, the temperature variation of the detector 12 is reduced.

It will be apparent from the foregoing that more than two studs can be used in the thermal damper of the present invention. By increasing the number of studs, the temperature waves of the thermal energy flowing between the detector mount 16 and the coldfinger 18 can be offset more effectively. In addition, it is also apparent that a single stud may be used in which the length, specific heat, and thermal conductivity of the stud are so chosen as to produce the requisite temperature variation by minimizing the $e^{-l\sqrt{\pi fCp/k}}$ term in the above equation. In designing the thermal damper with a single stud, the heat produced by the detector 12 ($T_i$) and expander cylical frequency (f) are generally set parameters, whereas the length (l), specific heat ($C_p$) and thermal conductivity (k) of the stud are variables. Assuming that one chooses a material such as 304 stainless steel (thereby defining Cp and k), and assuming an expander frequency of 15 Hz at a nominal operating temperature of 80° K., the following performance figures can be calculated:

| Length (inches) | Material | Damper Factor $e^{-l\sqrt{\pi fCp/k}}$ | Temperature Wave Reduction Factor ($T_iT_o$) |
|---|---|---|---|
| 0.10 | 304 CRES | $8.59 \times 10^{-4}$ | $1.164 \times 10^{3}$ |
| 0.20 | 304 CRES | $7.38 \times 10^{-7}$ | $1.355 \times 10^{6}$ |

It should be understood that while the invention was described in connection with a particular example thereof, other modifications will become apparent to those skilled in the art after a study of the specification, drawings and following claims.

What is claimed is:

1. A method for reducing temperature variation in an infrared detector, said method comprising the steps of:

providing a source of thermal energy operable to cool said detector, the temperature of said source of thermal energy varying according to a predetermined frequency;

dividing the flow of thermal energy between said source and said detector into at least two paths each having a temperature wave;

producing a phase shift in the temperature wave of the thermal energy flowing through at least one of said paths; and recombining the flow of thermal energy through each of said paths to reduce the temperature variation in said detector.

2. The method of claim 1, wherein at least one of said paths is through a material operable to cause a phase shift in the temperature wave of the thermal energy flowing through at least one of said paths.

3. The method of claim 1, wherein the flow of thermal energy between said source and said detector is divided by placing at least two studs of different lengths between said source and said detector.

4. The method of claim 3, wherein one stud is designed to obtain a predetermined reduction in the temperature variation of said detector by selecting the length and material from which said one stud is composed according to the following equation:

$$T_o = T_i e^{-l\sqrt{\pi f C_p/k}} \cos(2\pi f\tau - l\sqrt{\pi f C_p/k})$$

where:

$T_o$=temperature variation at the end of said one stud closest to said detector $T_i$=temperature variation at the end of said one stud closest to a sink of thermal energy l=length of stud f=predetermined frequency (Hz)

Cp=specific heat of said one stud k=thermal conductivity of said one stud $\tau$=time.

5. The method of claim 1, wherein:

said sink of thermal energy is a coldfinger connected to an expander operating at a given frequency.

6. A method for reducing temperature variation in an infrared detector, said method comprising the steps of:

providing a sink of thermal energy operable to cool said detector, the temperature of said sink of thermal energy varying according to a predetermined frequency;

locating a thermal conductor between said sink and said detector, said thermal conductor being designed to obtain a predetermined reduction in the temperature variation of said detector by selecting the length and material from which at least a portion of said thermal conductor is composed of according to the following equation:

$$T_o = T_i e^{-l\sqrt{\pi f C_p/k}} \cos(2\pi f\tau - l\sqrt{\pi f C_p/k})$$

where:

$T_o$=temperature variation at the end of said thermal conductor closest to said detector $T_i$=temperature variation at the end of said thermal conductor closest to said sink of thermal energy l=length of said thermal conductor f=said predetermined frequency (Hz)

Cp=specific heat of said thermal conductor k=thermal conductivity of said thermal conductor $\tau$=time; and conducting thermal energy from said detector to said sink through said thermal conductor.

7. The method of claim 6, wherein said thermal conductor comprises a single stud.

8. The method of claim 6, wherein said sink of thermal energy is a coldfinger of a cryoengine assembly.

9. The method of claim 8, wherein said thermal conductor comprises at least two studs thermally communicating with both said coldfinger and said detector and creating at least two thermal paths between said detector and said coldfinger.

10. The method of claim 9, wherein the thermal energy is conducted by said studs according to at least two generally sinusoidal temperature waves, at least two of said studs having lengths and composed from materials operable to shift the phase of at least one of said temperature waves by a predetermined angle with respect to at least one other of said temperature waves.

11. The method of claim 9, wherein said studs are composed of the same thermally conductive material and have different lengths.

12. An apparatus for reducing the temperature variation in an infrared detector, said apparatus comprising:

means for receiving thermal energy from said detector; and means for defining at least two different thermal paths from said source to said detector, each of said paths conducting thermal energy according to a generally sinusoidal temperature wave, and paths constructed of a material and of a length chosen such that the temperature wave through one of said paths is shifted with respect to the temperature wave in at least one other path wherein the temperature variation at the detector is reduced.

13. The apparatus of claim 12, wherein said means for defining at least two different thermal paths comprises at least two studs disposed between said means for receiving thermal energy and said detector.

14. The apparatus of claim 13, wherein at least two of said studs having lengths and composed of materials operable to allow said at least two studs to conduct thermal energy in temperature waves having different phase angles.

15. The apparatus of claim 12, wherein said apparatus further includes means for combining at least two temperature waves, said means for combining thermally communicating with said detector and operable to reduce temperature variation of said detector when at least two of said temperature waves are offsetting.

16. The apparatus of claim 13, wherein said means for receiving thermal energy is a coldfinger of a cyroengine assembly.

17. The apparatus of claim 16, wherein said means for defining at least two different thermal paths includes a plurality of bosses disposed between said coldfinger and said studs.

18. The apparatus of claim 17, wherein said studs are comprised of materials selected from the group consisting of stainless steel and titanium.

19. The apparatus of claim 18, wherein said means for combining comprises a detector mount which is operable to provide mechanical support to said detector.

20. The apparatus of claim 19, wherein said studs longitudinally extend between said bosses and said detector mount.

* * * * *